United States Patent [19]

Kriss

[11] Patent Number: 4,736,876

[45] Date of Patent: Apr. 12, 1988

[54] PORTABLE DISPENSER

[76] Inventor: Carol A. Kriss, 10455 ½ Ashton, W. Los Angeles, Calif. 90024

[21] Appl. No.: 431,813

[22] Filed: Sep. 30, 1982

[51] Int. Cl.[4] ..... A45F 3/16

[52] U.S. Cl. ..... 224/148; 224/219; 224/267; 222/175

[58] Field of Search ..... 206/37, 484, 522; 224/219, 221, 222, 267, 901, 148; 2/162, DIG. 6; 272/119; 273/58 R, 58 B; 222/175, 510, 552

[56] References Cited

U.S. PATENT DOCUMENTS

| | | | |
|---|---|---|---|
| 765,472 | 7/1904 | Gasaway et al. | 224/148 |
| 2,235,350 | 3/1941 | Anderson | 224/148 |
| 2,410,200 | 10/1946 | Celestin | 224/219 |
| 3,070,479 | 12/1962 | Meyer | 273/58 B |
| 3,427,022 | 2/1969 | Ward | 273/58 R |
| 3,532,339 | 8/1968 | Smith | 272/119 |
| 3,567,463 | 2/1969 | Williams | 206/484 |
| 3,605,374 | 9/1971 | Mueller et al. | 206/484 |
| 3,924,851 | 12/1975 | Winston | 272/119 |
| 4,069,954 | 1/1978 | Rauch | 224/901 |
| 4,085,244 | 4/1978 | Stillman | 206/484 |
| 4,100,681 | 7/1978 | Hollander | 206/484 |
| 4,139,130 | 2/1979 | Glusker et al. | 224/148 |
| 4,192,502 | 3/1980 | Owen | 272/119 |
| 4,228,215 | 10/1980 | Hein, III et al. | 206/484 |
| 4,262,801 | 4/1981 | Avery | 206/522 |
| 4,342,395 | 8/1982 | Brown | 206/484 |

FOREIGN PATENT DOCUMENTS

| | | | |
|---|---|---|---|
| 563170 | 8/1974 | Switzerland | 272/119 |

*Primary Examiner*—David T. Fidei

*Attorney, Agent, or Firm*—Lyon & Lyon

[57] ABSTRACT

A linear array of flexible containers suitable for holding and dispensing liquid or semi-liquid substances is disclosed. The array is arranged so that the series of packets may be worn about a portion of the body, for example, the wrist.

2 Claims, 1 Drawing Sheet

PORTABLE DISPENSER

BACKGROUND OF THE INVENTION

The present invention relates to transporting and accessing needed materials, in particular toiletries and cosmetics. In particular, the invention concerns a dispenser which can be worn on the person and which contains the desired liquid and semi-liquid supplies. In its most convenient form, the dispenser is constructed so as to be fastened around the wrist of a wearer, and comprises a multiplicity of flexible dispensing compartments.

A number of situations arise in which it is inconvenient to provide access to the several supplies needed for a particular activity. A familiar example is the desirability of accessing shampoo, soap, lotions and other cleansing agents in the shower. It is not uncommon for a single individual to require the use, during that limited time, of shampoo, hair conditioner, soap or cleansing cream, body lotion, etc. during the course of a single shower. These materials are frequently supplied in liquid or semi-liquid form, and are commonly stored in bottles or tubes. Various devices have been contrived for providing access to these supplies, including shelves which are mounted on the shower stall, catchall bags which are suspended from hooks or other supporting hardware, and carriers or caddies which are mounted over the shower head. Of course, the utility of these means of access is limited to those situations where the user has more or less permanent control of the shower area. It is not a satisfactory arrangement in shower areas used only in a transient manner and by a number of people, such as those in health spas, swimming pools, or athletic clubs. In those instances, it is not possible to leave the supplies stored in the shower, and they must be transported with the particular individual.

It would be convenient to provide a dispenser which may be conveniently carried by the individual and which has the capacity for transporting and dispensing a number of supplies of the aforementioned type. Containers have been designed, suitable for wearing about the wrist, which are capable of carrying, for example, paste (U.S. Pat. No. 1,632,890) or solid or semi-solid cosmetics (U.S. Pat. No. 1,609,481) and for a single type of lotion (U.S. Pat. No. 2,235,350). A container for dispensing cigarettes designated to be worn around the wrist or ankle has also been disclosed (U.S. Pat. No. 2,410,200). However, none of these containers has the characteristics of the dispenser of the present invention, as both easily carried, and able conveniently to dispense several liquid or semi-liquid materials in suitable quantities for the uses intended.

SUMMARY OF THE INVENTION

The invention herein concerns a band, of such dimensions as to be worn around the wrist, ankle, or other part of the body, which comprises a series of flexible containers of suitable volume to accomodate and dispense appropriate amounts of liquid or semi-liquid materials. The containers are flexible and have access ports whereby the material contained within them may be dispensed or refilled, and are sequentially arranged along the band. The ends of the band are capable of fastening one end to each other so as to create an annular sequence of dispensing containers held in place by encircling, for example, the wrist.

It is the object of the present invention to provide a dispenser for liquids and semi liquids which is waterproof, flexible, non-breakable, and confortable to wear.

It is a further object of the invention to provide a conveniently used and carried personal carrying case and dispenser for materials that will be needed to be accessed by an individual in the course of activities which require the use of these materials.

DETAILED DESCRIPTION

Figure 1:
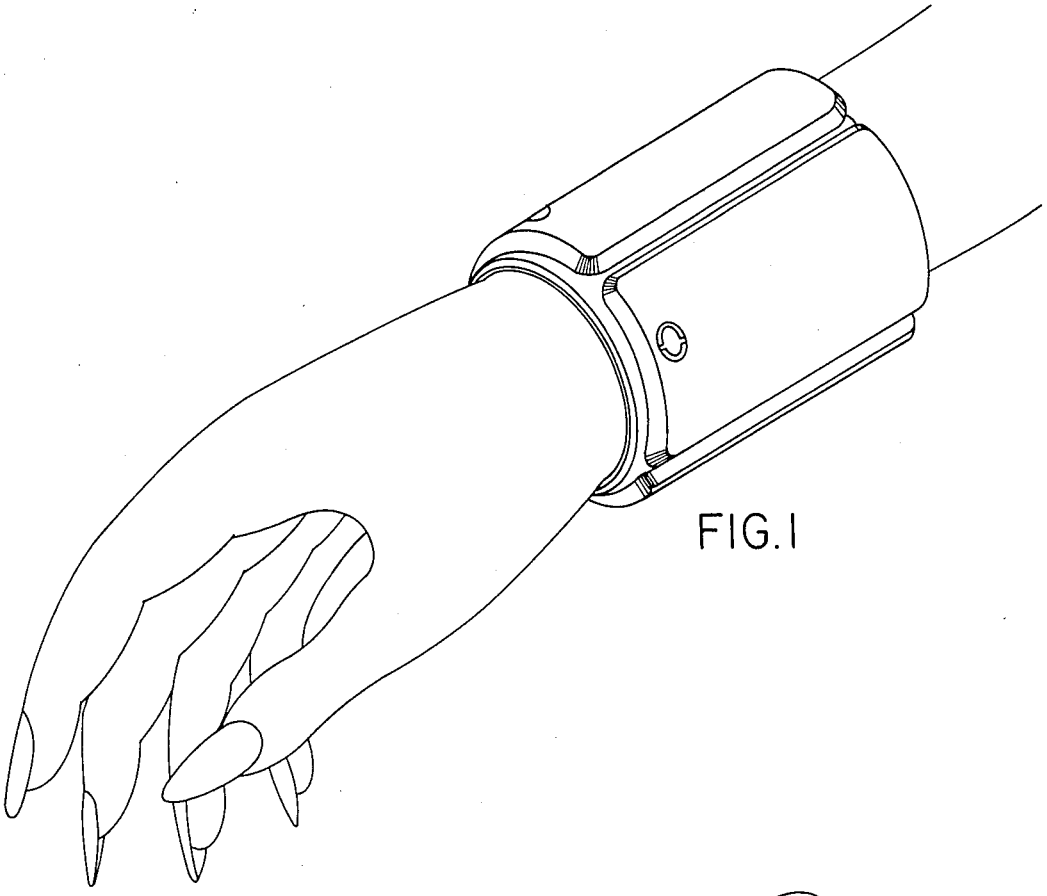
FIG. 1 shows a preferred embodiment as typically worn on the wrist by a user.

In general, the invention comprises a linear array of flexible containers or "packets." Each packet has an inlet/outlet portal by means of which liquid or semi-liquid contents may be dispensed or refilled. The packets are flexible and compressible so that the material they contain may be squeezed out of the portal in a reasonably controlled manner. Each packet is connected with one (if at the end of the sequence) or two (if in the body of the sequence) packets adjoining it and, in a preferred embodiment, through substantially the full length of one side. The number and dimensions of the packets are adjusted so as to provide a suitable number of containers for the desired purpose, to provide an appropriate amount of storage and dispensing capacity for the supplies to be contained therein, and to form a linear array of suitable length to be attached to a human being by encircling some portion of the body. The ends of the linear array are provided with a means for fastening one end to the other to form an annular configuration such that the array can be supported by, for example, circling it about the wrist as a bracelet, or around the ankle, or even the waist. A preferred disposition around the wrist is shown in FIG. 1.

Figure 2:
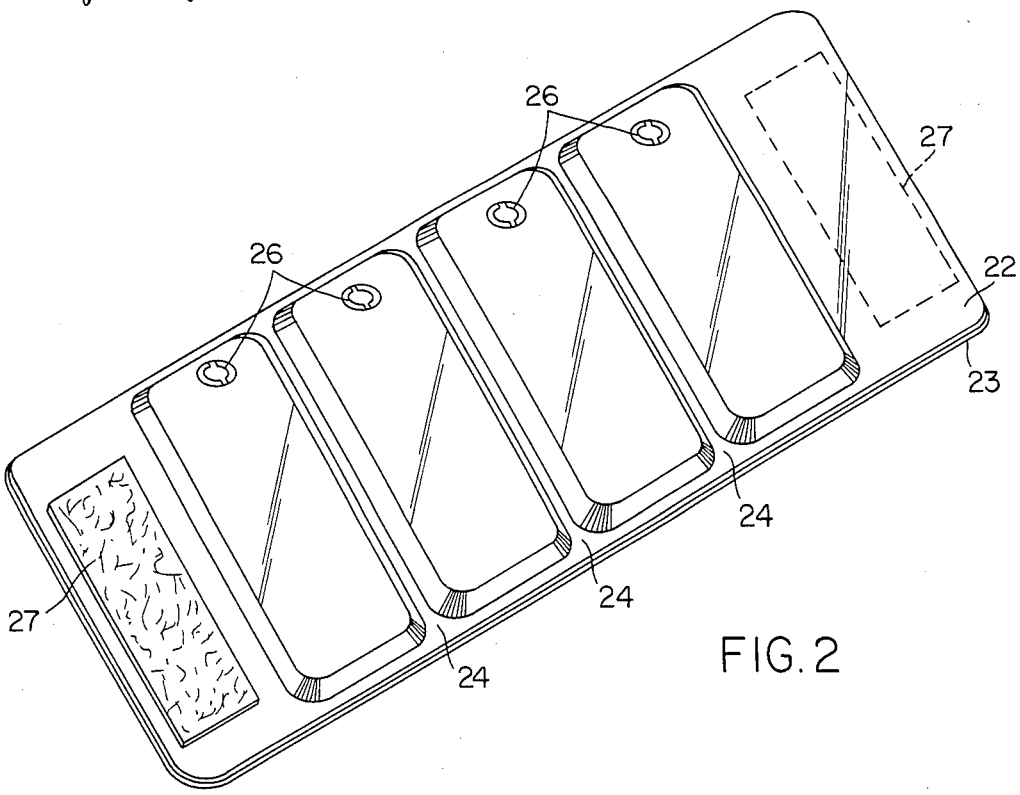
FIG. 2 shows the construction of a particularly preferred embodiment of the invention.

In a preferred embodiment, the packet series is constructed of a flexible plastic or polymeric material, such as, for example, polyethylene, a vinyl polymer, or polyisoprene. The construction of a particularly preferred embodiment is shown in FIG. 2. Two matching bands or strips 22, 23 of the polymeric material are used in the construction to form a bilayer. A portion of the length of the strips at each end is heat sealed, as are short segments 24, perpendicular to the linear axis of the strips, so as to form a series of sealed and unsealed sections of the bilayered strips. The total length of the unsealed portions comprises the greater portion of the running length along the band than does that of the sealed portions, and the unsealed portions are expanded preferably by vacuum to form the containers or packets for dispensing of supplies. In the embodiment shown in FIG. 2, the ends of these packets or containers are heat sealed while in expanded form. (End seals could also be provided by supplying end pieces of similar polymeric material and sealing these end pieces to the openings created by the expanded unsealed portions of the two strips). In addition, an opening is cut into each of the resulting containers and a suitable inlet/outlet portal 26 is installed therein with a means for opening and closing the access to the containers. Suitable portal designs are commonly known; those customarily used as inlet/outlet portals on, for example, childrens' inflatable toys and plastic swimming pools are appropriate. These portals are simple, circular holes into which a conforming peg can be inserted for closing. Other arrangements, such as screw caps similar to those used on, for example, plastic tube dispensers for shampoo are also practicable, and can be installed by heat sealing into the opening.

As shown in FIG. 2, the resulting preferred configuration of the dispenser comprises a sequential array of containers, alligned in parallel, of approximately equal size, each with its own dispensing and refill port. The ends of the bilateral strips are provided with a means to fasten each end to the other. As shown in the preferred embodiment of FIG. 2, this means comprises a Velcro pad 27 at each end so that the entire band can be simply circled about the wrist, as shown in FIG. 1, and secured by the innate properties of the Velcro on counterfacing pads. (Velcro is the registered trademark of Velcro, U.S.A., Inc., Manchester N. H., for a hook and loop fastening system.)

In the particularly preferred embodiment set forth above, the packets are approximately 2–3 inches by 4–5 inches, preferably about 2 inches by 4½ inches, and the entire array including the sealing means at the end of the strips is approximately 11–13 inches, preferably about 12 inches in length. An approximately 2 inch wide Velcro pad is adequate to secure the bracelet, and the array can be accomodated to the size of a particular wrist by adjusting the position of the Velcro pads and/or the dimensions of the sealing portions at the ends of the bilayer.

While the preferred embodiment described above is particularly convenient, it is clear that the utility and practicality of the invention is not limited to that specifically shown. For example, the number of packets available for filling and dispensing can vary with the needs of a particular situation, as can the specific shape and size of the containers. The design of these factors will depend in some measure on the intended use. While the above design is a particularly suitable for dispensing, for example, shampoo, lotion, or hair conditioner, any liquid or semi-liquid material can be accomodated in this way. For example, the same basic design might be used for dispensing a series of oil paints by an artist who needs to travel by foot some distance to the site of the subject matter of his intended painting. In addition, if a greater multiplicity of packets were desired, sealing a linear segment parallel to the linear axis of the band at approximately the center of the bilayer (i.e. perpendicular to the sealed segments shown in FIG. 2), would double the number of containers available. Other permutations to accomodate variations in length and volume of the dispenser can also be made.

Further, besides Velcro, other means are available to provide fastening of the two ends. Hook and eye arrangements, snaps, or buttons and button holes, while less preferred, are workable in the practice of the invention.

Thus, the foregoing detailed illustration of the preferred embodiment should not be construed to limit the scope of the invention, which is defined by the following claims.

I claim:

1. A portable liquid dispenser to be worn on the human body for storing and selectively dispensing various liquids such as body lotions, shampoos, conditioners, creams and the like, comprising in combination, a body extending longitudinally in one direction and including two generally elongated strips of flexible plastic waterproof material arranged in overlying relationship forming a bilayer, such strips being heat sealed together along spaced locations extending transversely of said one direction and along opposite side edge margins of said strips to form a plurality of separate individual watertight containers spaced substantially throughout the longitudinal extent of said body, said containers including opposed upper and lower flexible and expandable wall portions of said strips located between said sealed locations and adapted to receive various different liquids within the confines thereof, each of said upper wall portions having a valve means including a portal in the upper wall portion for introducing a liquid into and dispensing the liquid from the associated container, and a valve member in each portal for sealing liquid within each compartment, said valve member being removable from its associated portal to permit liquid to be introduced through said portal into the associated container or dispensed through said portal from the associated container, said valve member being reinsertable within the portal to seal the liquid within the associated container, said lower wall portions being free of any portals and adapted to engage a portion of a user's body such as the wrist or ankle, fastening means on opposite end portions of said body for securing the dispenser body about a portion of the user's body such as the wrist or ankle with the upper wall portions outwardly exposed for access to the valve means, said dispenser body adapted to be worn on the user's body with the lower wall portions engaging the user's body and the upper wall portions and valve member exposed to facilitate dispensing of the liquid from the containers, said wall portions being selectively squeezable to dispense liquid from a selected container through the associated portal upon removal of the associated valve member.

2. The dispenser defined in claim 1 wherein said upper wall portions of said containers have opposite end regions, and said portals are each located in one of said end regions to facilitate dispensing of the liquid from the containers.

* * * * *